United States Patent [19]

Wakabayashi et al.

[11] Patent Number: 5,035,101

[45] Date of Patent: Jul. 30, 1991

[54] PACKAGING MACHINE

[75] Inventors: Shigeru Wakabayashi; Masao Shimokawa, both of Tokushima, Japan

[73] Assignee: Shikoku Kakoki Co., Ltd., Tokushima, Japan

[21] Appl. No.: 596,823

[22] Filed: Oct. 12, 1990

[30] Foreign Application Priority Data

Oct. 31, 1989 [JP] Japan ..... 1-128362[U]

[51] Int. Cl.[5] ..... B65B 57/08

[52] U.S. Cl. ..... 53/53; 53/67; 53/271; 53/425

[58] Field of Search ..... 53/426, 425, 53, 69, 53/67, 504, 271, 285, 275, 274, 266 R, 110, 510

[56] References Cited

U.S. PATENT DOCUMENTS

| | | | |
|---|---|---|---|
| 2,763,107 | 9/1956 | Day et al. | 53/110 X |
| 3,261,140 | 7/1966 | Long et al. | 53/425 X |
| 3,377,776 | 4/1968 | Arvidson | 53/53 X |
| 3,708,949 | 1/1973 | Wilcox | 53/53 |

FOREIGN PATENT DOCUMENTS

| | | | |
|---|---|---|---|
| 8701293 | 1/1989 | Netherlands | 53/425 |

*Primary Examiner*—James F. Coan

*Attorney, Agent, or Firm*—Armstrong, Nikaido, Marmelstein, Kubovcik & Murray

[57] ABSTRACT

A packaging machine comprises an aseptic chamber having a required packaging work space as separated from the outside air, a container outlet and a closure for the outlet, an inner container conveyor disposed inside the chamber to provide an inner path of transport of containers, an outer container conveyor disposed outside the chamber to provide an outer path of transport of containers, a fixed transfer member interposed between the outlet and the terminal end of the inner transport path, a movable transfer member interposed between the outlet and the starting end of the outer transport path and movable about its front end upward to a raised position or downward to a horizontal position, and means for successively forwarding containers on the fixed transfer member from its rear end to the front end thereof and then delivering the containers from the front end to the rear end of the movable transfer member in the horizontal position. Before the closure is closed when the packaging operation has been completed to keep the interior of the chamber aseptic, the movable transfer member, which is in the horizontal position during the operation, is brought to the raised position, thereby preventing the movable transfer member from interfering with the closure and permitting the containers on the member to slide down onto the outer path starting end under gravity.

7 Claims, 8 Drawing Sheets

PACKAGING MACHINE

BACKGROUND OF THE INVENTION

The present invention relates to packaging machines, and more particularly to a machine which has an aseptic chamber having a minimized required space as separated from the outside air and which is adapted to fill contents such as fluid food into containers within the chamber, then seal the containers therein and finally discharge the filled containers from the chamber.

Such a machine is already known which comprises an aseptic chamber separating a required packaging work space from the outside air and having a front wall with a container outlet formed therein, an inner container conveyor disposed inside the chamber to provide an inner path of transport of containers, the inner transport path having a terminal end positioned to the rear of the container outlet at a distance therefrom, a transfer plate interposed between the container outlet and the terminal end of the path and having a rear end connected to the terminal end, and an outer container conveyor disposed outside the chamber to provide an outer path of transport of containers, the outer transport path having a starting end connected to the front end of the transfer plate. Containers are delivered from the inner transport path onto the transfer plate, and moved on the plate from its rear end to the front end thereof, passed through the outlet and transferred to the staring end of the outer transport path by being pushed forward by the following containers.

With the above machine, the chamber must be closed with a closure when the packaging operation has been completed to keep the interior of the chamber aseptic. On completion of the packaging operation, no container remains on the inner conveyor within the chamber, whereas some containers remain on the transfer plate and need therefore to be manually removed by the operator before the closure is closed, hence a cumbersome procedure. Further when to be closed, the closure interferes with the outer conveyor outside the chamber, so that the conveyor must be shifted. This is also cumbersome.

SUMMARY OF THE INVENTION

The main object of the present invention is to provide a convenient packaging machine of the type described which is adapted to automatically discharge containers completely from the aseptic chamber on completion of the packaging operation and which is free of the likelihood that the closure will interfere with the conveyor outside the chamber.

The present invention provides a packaging machine which comprises: a closed aseptic chamber having a required packaging work space as separated from the outside air and a front wall formed with a container outlet; a closure pivotally movably attached to the outer side of the front wall at an edge portion of the container outlet; an inner container conveyor disposed inside the chamber to provide an inner path of transport of containers, the innter transport path having a terminal end positioned to the rear of the container outlet at a distance therefrom; an outer container conveyor disposed outside the chamber to provide an outer path of transport of containers, the outer transport path having a starting end positioned in front of the container outlet at a distance therefrom; a fixed transfer member interposed between the container outlet and the terminal end of the inner transport path and having a rear end connected to the terminal end of the inner transport path; a movable transfer member interposed between the container outlet and the starting end of the outer transport path and movable about its front end upward to a raised position or downward to a horizontal position, the movable transfer member being connected at its front end to the starting end of the outer transport path and at its rear end to the front end of the fixed transfer member when in the horizontal position, the movable transfer member having its front end held connected to the starting end of the outer transport path and its rear end disconnected from the front end of the fixed transfer member when moved to the raised position; mean for successively forwarding containers on the fixed transfer member from its rear end to the front end thereof and then delivering the containers from the front end to the rear end of the movable transfer member in the horizontal position; and means for moving the movable transfer member between the horizontal position and the raised position so as to bring the movable transfer member to the raised position, thereby rendering the movable transfer member free of interference with the closure and permitting the containers on the movable transfer member to slide down onto the starting end of the outer transport path under gravity.

According to the invention, containers are delivered from the terminal end of the inner transport path to the fixed transfer member, sent forward on the fixed transfer member from its rear end to the front end thereof by the forwarding means and further transferred from the front end to the rear end of the movable transfer member in the horizontal position, so that when the packaging operation has been completed, the containers remaining inside the chamber can be automatically discharged therefrom completely.

When the movable transfer member is moved to the raised position after the containers have been completely discharged from the chamber, the containers on the movable transfer member are allowed to slide down onto the starting end of the outer transport path and further transported by the outer conveyor. The movable transfer member is then free of interference with the closure to be closed, with the result that the closure can be closed without the necessity of shifting the outer container conveyor.

DESCRIPTION OF THE PREFERRED EMBODIMENT

An embodiment of the invention will be described below with reference to the drawings.

Figure 5:
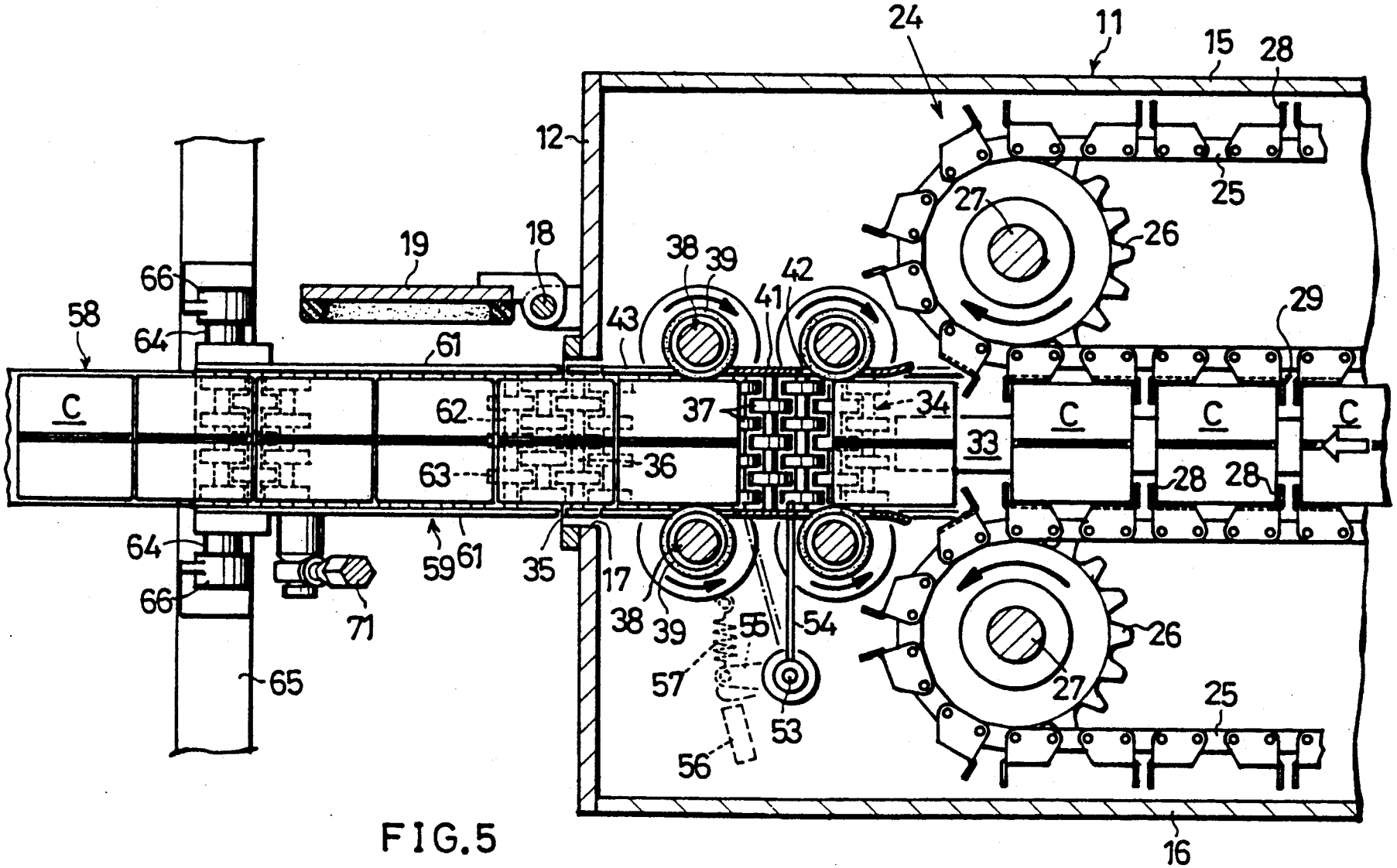
FIGS. 5, 6 and 7 are views in section taken along the lines V—V, VI—VI and VII—VII in FIG. 4, respectively.
Figure 6:
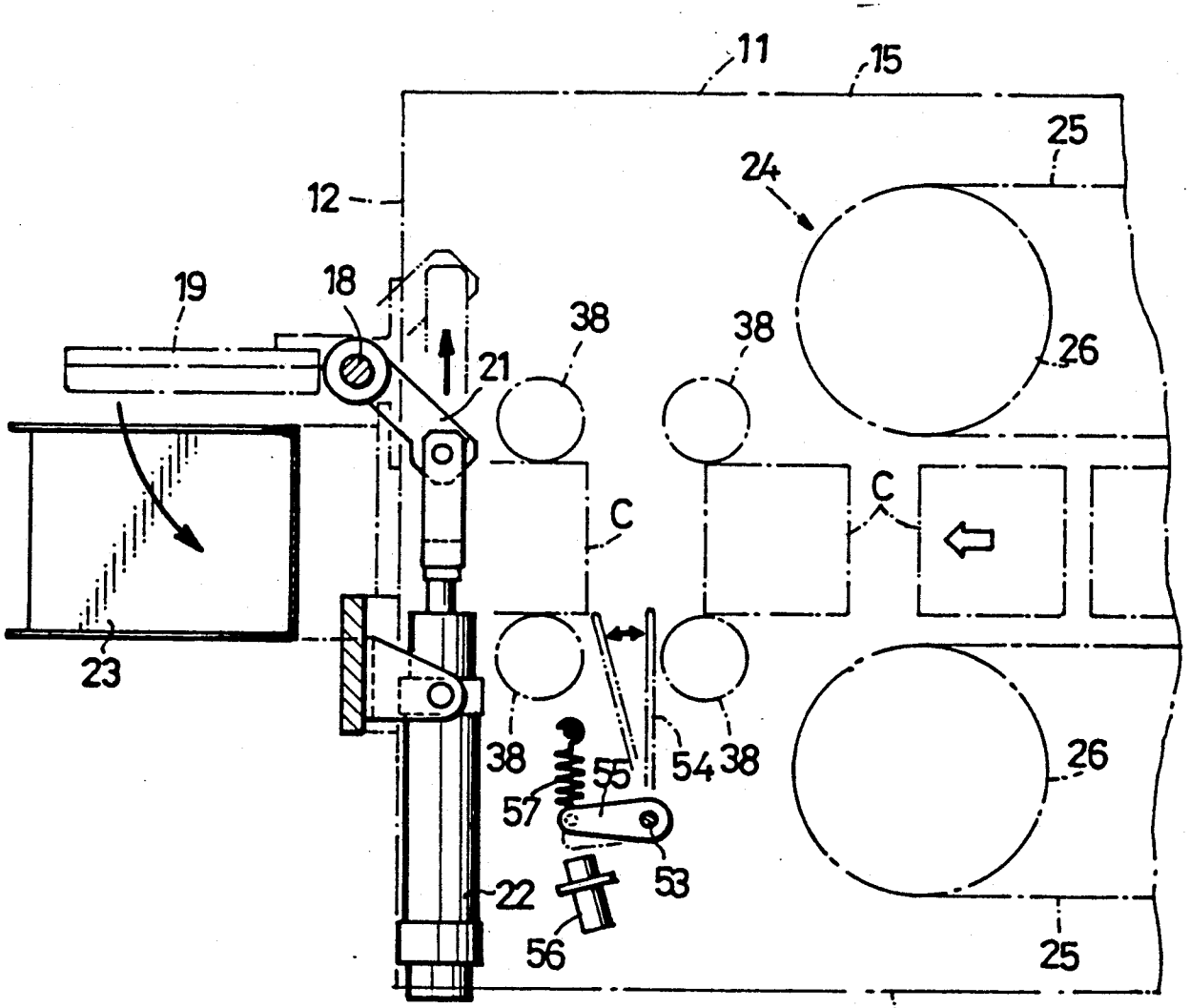

The term "front" as used herein refers to the direction in which containers are transported through an aseptic chamber 11 (i.e., leftward in FIGS. 4 to 6), and the term "rear" to the opposite direction. The terms "right" and "left" are used as the machine is seen rearward.

Figure 7:
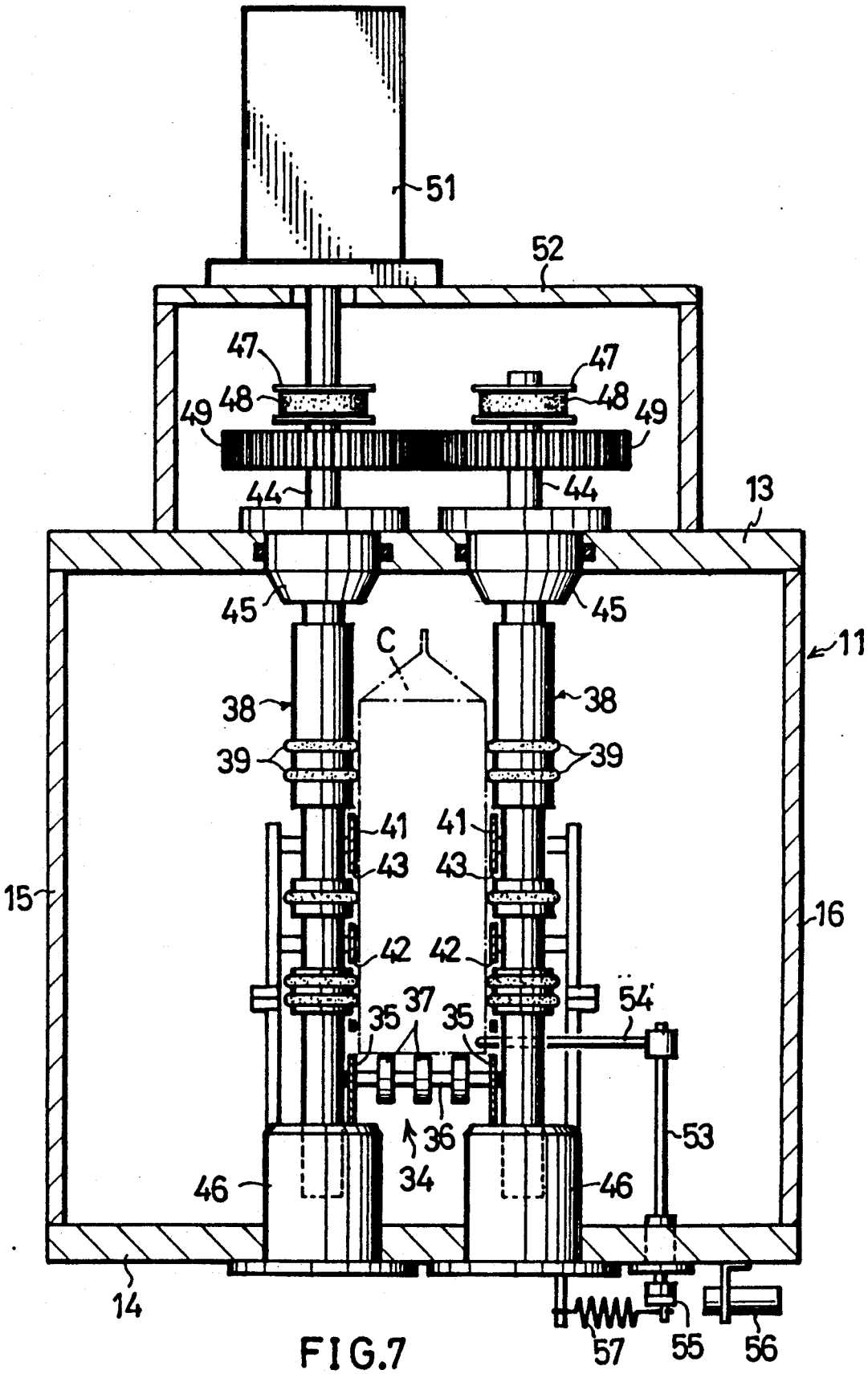
Figure 8:
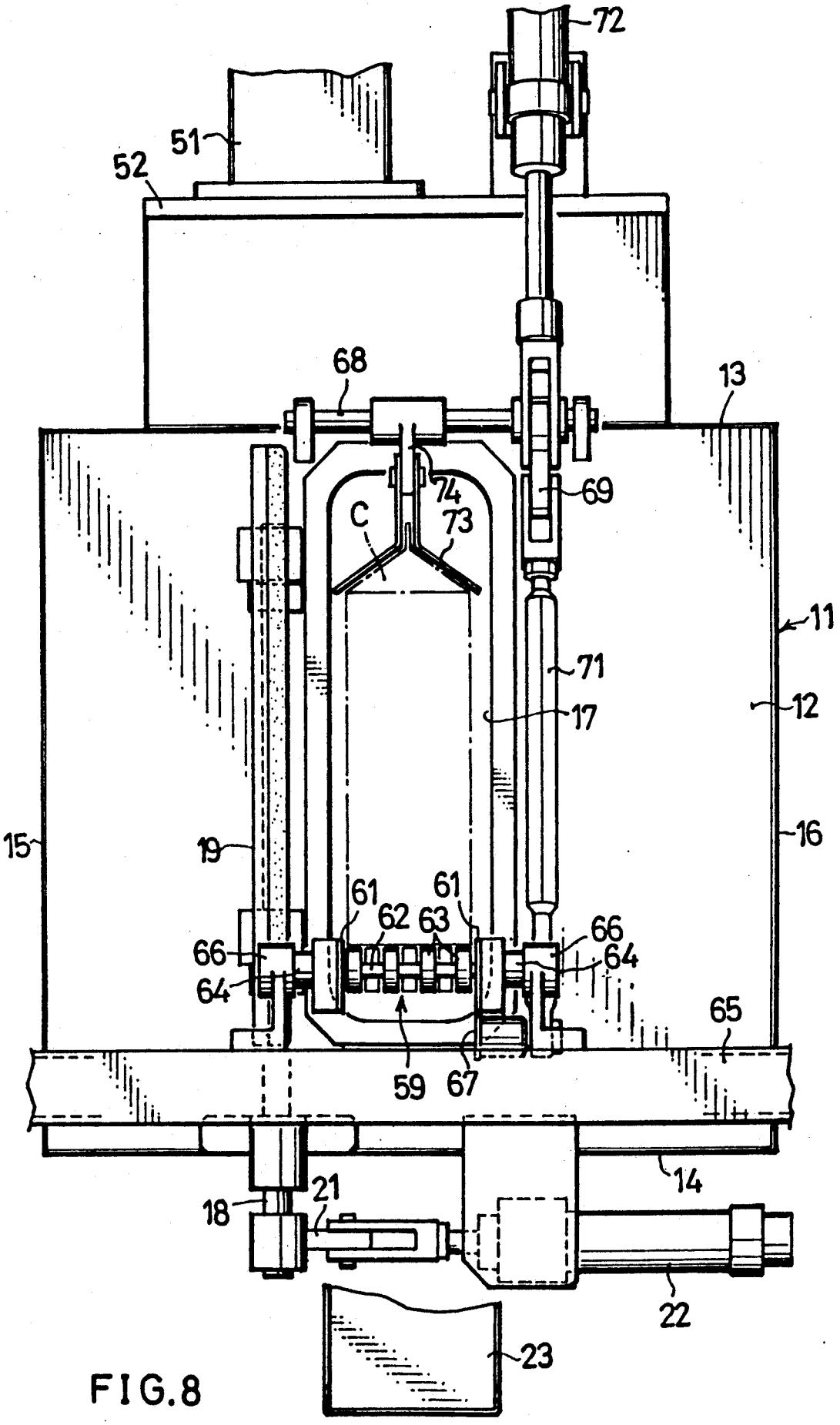
FIG. 8 is a view showing the machine as it is seen in the direction of the arrows VIII—VIII.

The packaging machine prepares three kinds of rectangular paprallelepipedal containers of paperboard having a gabled roof, identical in cross sectional area, made different in height and thereby given different capacities, e.g., 250 ml, 500 ml and 1000 ml. Although all kinds of containers are not shown, FIGS. 7 and 8 show the hightest container C.

The aseptic chamber 11 of the packaging machine is in the form of a box elongated longitudinally of the machine and has a front wall 12, top wall 13, bottom wall 14, right and left side walls 16, 15, and rear wall (which is not shown). The front wall 12 is formed with a vertically elongated rectangular outlet 17. A vertifal pivot 18 having a closure 19 fixed thereto is attached to the outer side of the front wall 12 a the left edge portion of the outlet 17. An arm 21 fixed to the lower end of the pivot 18 has connected to its forward end the piston rod of a horizontal hydraulic cylinder 22. The hydraulic cylinder 22 is attached to the front end of the chamber bottom wall 14 pivotally movably horizontally.

The chamber 11 is provided outside thereof with an emergency discharge chute 23 extending forward obliquely downward approximately from the lower end of the outlet 17.

An inner container conveyor 24 is disposed inside the chamber 11 and is in the form of a chain conveyor providing an inner path of transport extending longitudinally of the chamber 11. The conveyor 24 comprises two pairs of upper and lower endless chains 25 arranged on the respective right and left sides of the path, a pair of vertical drive shafts 27 arranged on the respective opposite sides of the path and each having a pair of upper and lower sprockets 26 with the pair of upper and lower endless chains 25 reeved therearound respectively, and a multiplicity of vertical pieces 28 L-shaped in cross section, connected between each pair of upper and lower chains 25 and arranged at predetermined distances longitudinally of the chains. Each of container holders 29 comprises two vertical pieces 28 on each side of the path of transport. When brought almost to the path side of the chains 25, the holder 29 comes into engagement with the four corners of trunk of the container C to hold the container C. In this state, the holder 29 restrains the container C from moving horizontally but renders the container free to move vertically.

Figure 3:
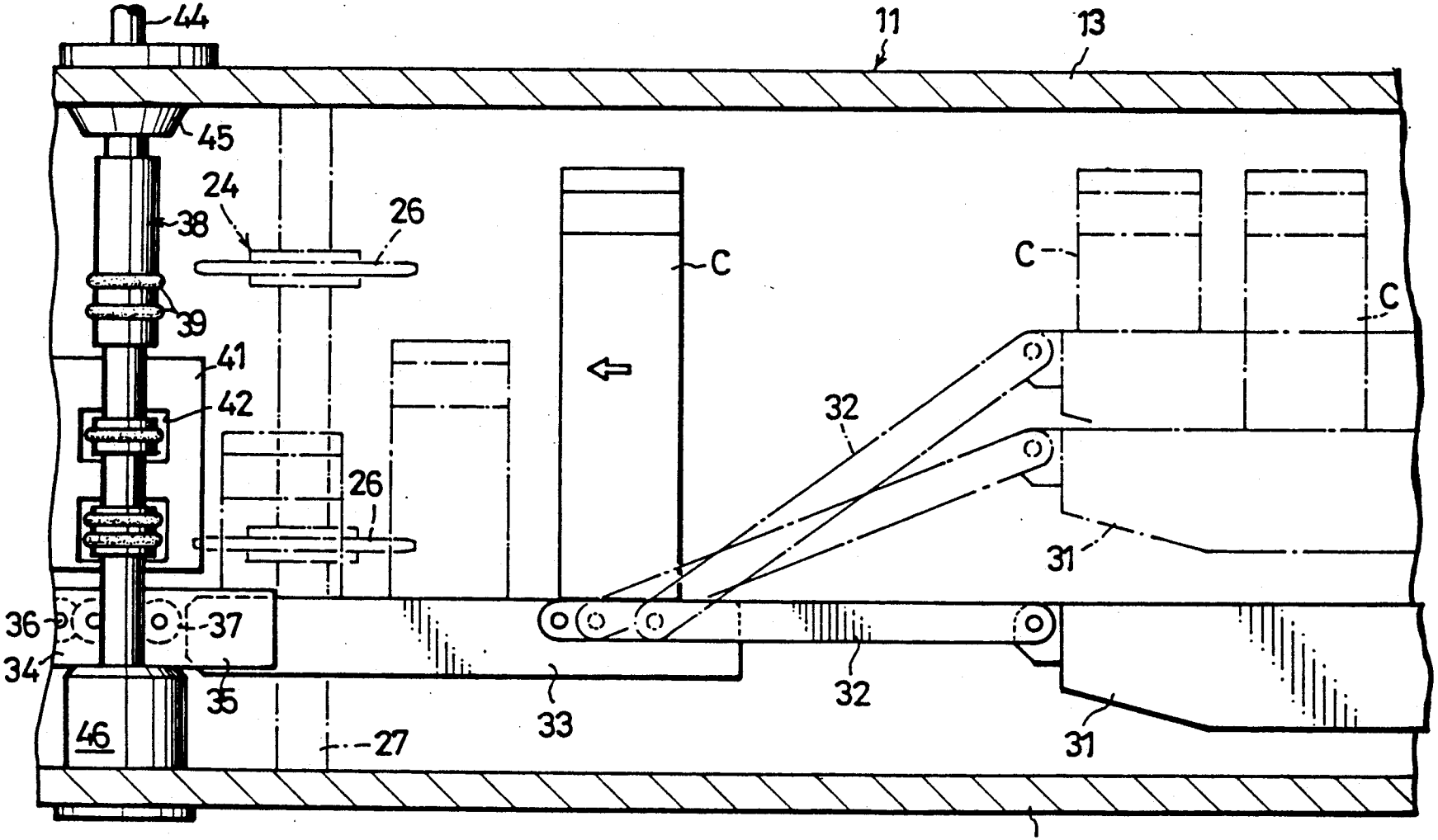
FIGS. 3 and 4 are views in vertical section showing the machine in the vicinity of the front portion.

With reference to FIG. 3, a liftable rail 31 for guiding containers C as held by the holders 29 by supporting them at the bottom extends under the path of movement of the holders 29 in parallel thereto. A tiltable rail 32 has a rear end pivoted to the front end of the liftable rail 31 and a front end connected to a fixed rail 33 movably longitudinally of the rail 33. The liftable rail 31 is raised or lowered by unillustrated means and is thereby adjustable to three levels in accordance with the three kinds of containers so that the upper ends of three kinds of containers as held by the holders 29 will be positioned at a definite level.

Inside the chamber 11, a fixed transfer member 34 is interposed between the outlet 17 and the terminal end of path of transport by the inner container conveyor 24. The fixed transfer member 34 comprises a pair of opposed side plates 35 extending longitudinally of the chamber 11, a plurality of horizontal support shafts 36 extending between and fixed to the side plates 35 and arranged at a spacing longitudinally of the chamber 11, and a plurality of rollers 37 mounted on each of the support shafts 36. The upper ends of the rollers 37 are at the same level as the upper surface of the fixed rail 33.

On opposite sides of the fixed transfer member 34, two pairs of right and left vertical pinch rollers 38 are spaced apart longitudinally of the chamber 11. The pinch rollers 38 in each pair are spaced apart by a distance slightly larger than the width of the container C. Each pinch roller 38 is provided with five elastic rubber rings 39 arranged at a predetermined distance. Opposed guide plates 41 each in the form of a vertical plate for guiding the side of the container are fixedly disposed above the respective side plates 35 of the fixed transfer member 34. The guide plate 41 on each side of the fixed transfer member 34 is positioned at a small distance inward from the surfaces of the pinch rollers 38 on the same side of the member 34. The guide member 41 is formed at required portions with apertures 42 and cutouts 43 for the inner ends of the elastic rings 39 on the corresponding rollers 38 to project therethrough inwardly of the member 41. Thus, the container C on the fixed transfer member 34 is held between the pairs of pinch rollers 38 with their elastic rings 39. All the five rings 39 are used for high containers of the three kinds of high, medium and low containers, the three lower rings 39 for medium containers, and the two lower rings 39 for low containers.

Each of the pinch rollers 38 has a rotary shaft 44 which is supported at its upper portion by an upper bearing 45 mounted on and extending through the chamber top wall 13 and at its lower portion by a lower bearing 46 projecting upward beyond the chamber bottom wall 14. The upper bearing 45 is removable from the top wall 13. The lower portion of the rotary shaft 44 is removable from the lower bearing 46. Accordingly, the pinch roller 38 can be removed upwardly from the chamber 11 for the replacement of the elastic rings 39.

The rotary shaft 44 of each pinch roller 38 has an upper end projecting upward beyond the upper bearing 45 and carrying a pulley 47 thereon. A belt 48 is reeved around the two pulleys 47 on the two pinch rollers 38 on each side of the fixed transfer member 34. The rotary shafts 47 of the pair of front pinch rollers 38 have mounted thereon a pair of gears 49 meshing with each other and positioned immediately below the corresponding pulleys 47. Of the pair of front pinch rollers 38, the roller 38 on the left side has its rotary shaft 44 connected to the output shaft of a motor 51, which is mounted as directed downward on a top wall of a cover 52 provided on the chamber top wall 13.

A vertical rotatable rod 53 is disposed to the right of the midportion between the two pinch rollers 38 on the right side and is supported by and extends through the chamber bottom wall 14. A container sensor arm 54 in the form of a horizontal rod is secured to the upper end of the rod 53 and has a free end which is movable into and out of the path of travel of the container C sent forward on the fixed transfer member 34. A sensor actuating arm 55 is secured to the lower projecting end of the rod 53. A proximity sensor 56 is disposed at a distance from the free end of the actuating arm 55 in a counterclockwise direction when seen from above. The actuating arm 55 is biased clockwise by a return spring 57 when seen from above.

When the container sensor arm 54 advanced into the path of travel of the container is pushed by one container C and thereby rotated counterclockwise as seen from above, the rotatable rod 53 is rotated in the same direction along with the actuating arm 55, whereupon the proximity sensor 56 detects the forward end of the actuating arm 55. Upon the container C moving past the sensor arm 54, the spring 57 rotates the sensor arm 54 clockwise to return the arm 54 to the original position. Thus, every time one container C passes, the container sensor arm 54 pivotally moves once, causing the proximity sensor 56 to produce a recurrent signal. Accordingly, the number of containers C discharged can be counted by counting the number of recurrences of signal. Further if some containers C jam the path of transfer at the location of the pinch rollers 38, failing to travel over the fixed transfer member 34, the sensor arm 54 remains in the path, causing the proximity sensor 56 to produce a continuous signal, which serves as an emergency stop signal.

Disposed outside the chamber 11 is an outer container conveyor 58 in the form of a belt conveyor and providing an outer path of transport of containers. This path has a starting end positioned in front of the outlet 17 at a distance therefrom. The transport surface of the conveyor 58 is at the same level as the fixed transfer member 34.

A movable transfer member 59 is interposed between the outlet 17 and the starting end of the outer transport path and is movable about its front end upward to a raised position or downward to a horizontal position. When in the horizontal position, the member 59 is at the same level as the fixed transfer member 34. The movable transfer member 59, substantially identical with the fixed transfer member 34 in construction, comprises a pair of opposed side plates 61 extending longitudinally of the machine, a plurality of horizontal support shafts 62 extending between and fixed to the side plates 61 and arranged at a spacing longitudinally of the machine, and a plurality of rollers 63 mounted on each of the support shafts 62, Each of the side plates 51 has a horizontal pin 64 projecting outward from its front end and supported by a bearing 66 on a support member 65. The right side plate 61 has a downward lug 67 positioned immediately in the rear of the pin 64. On the other hand, the chamber front wall 12 is provided on the outer side thereof with a horizontal pivot 68 along the upper edge of the outlet 17. An L-shaped arm 69 has one end secured to the right end of the pivot 68 and the other end connected to the downward lug 67 by a rod 71. An intermediate portion of the L-shaped arm 69 is connected to the piston rod of a slanting hydraulic cylinder 72. The hydraulic cylinder 72 is mounted on the top wall of the cover 52 at one side of the motor 51 and is pivotally movable upward or downward. A container top guide 73 inverted V-shaped in cross section is fixed by an arm 74 to the horizontal pivot 68 at a lengthwise intermediate portion thereof.

Figure 1:
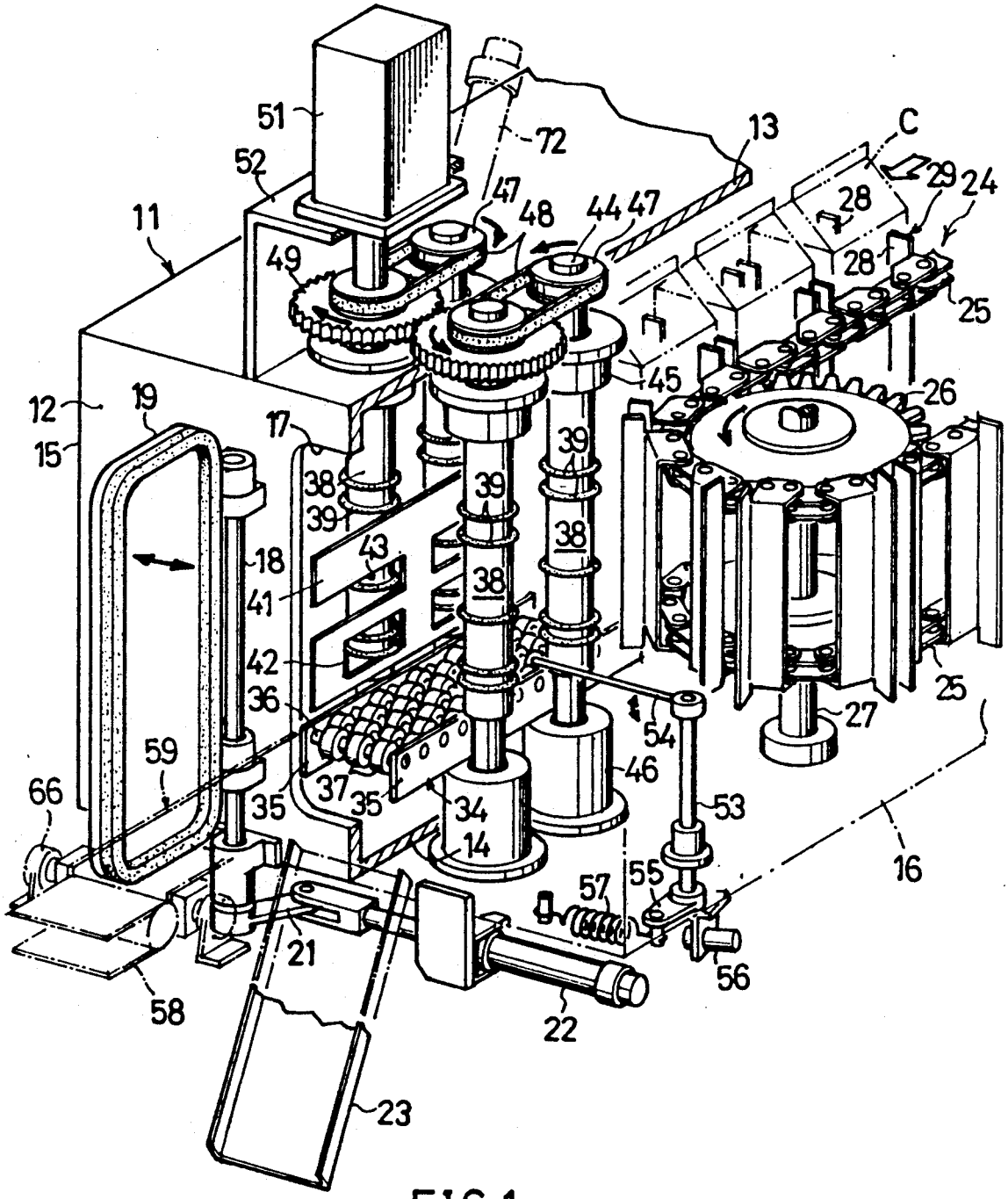
FIG. 1 is a perspective view partly broken away and showing the front portion of an aseptic chamber of a packaging machine embodying the invention.
Figure 2:
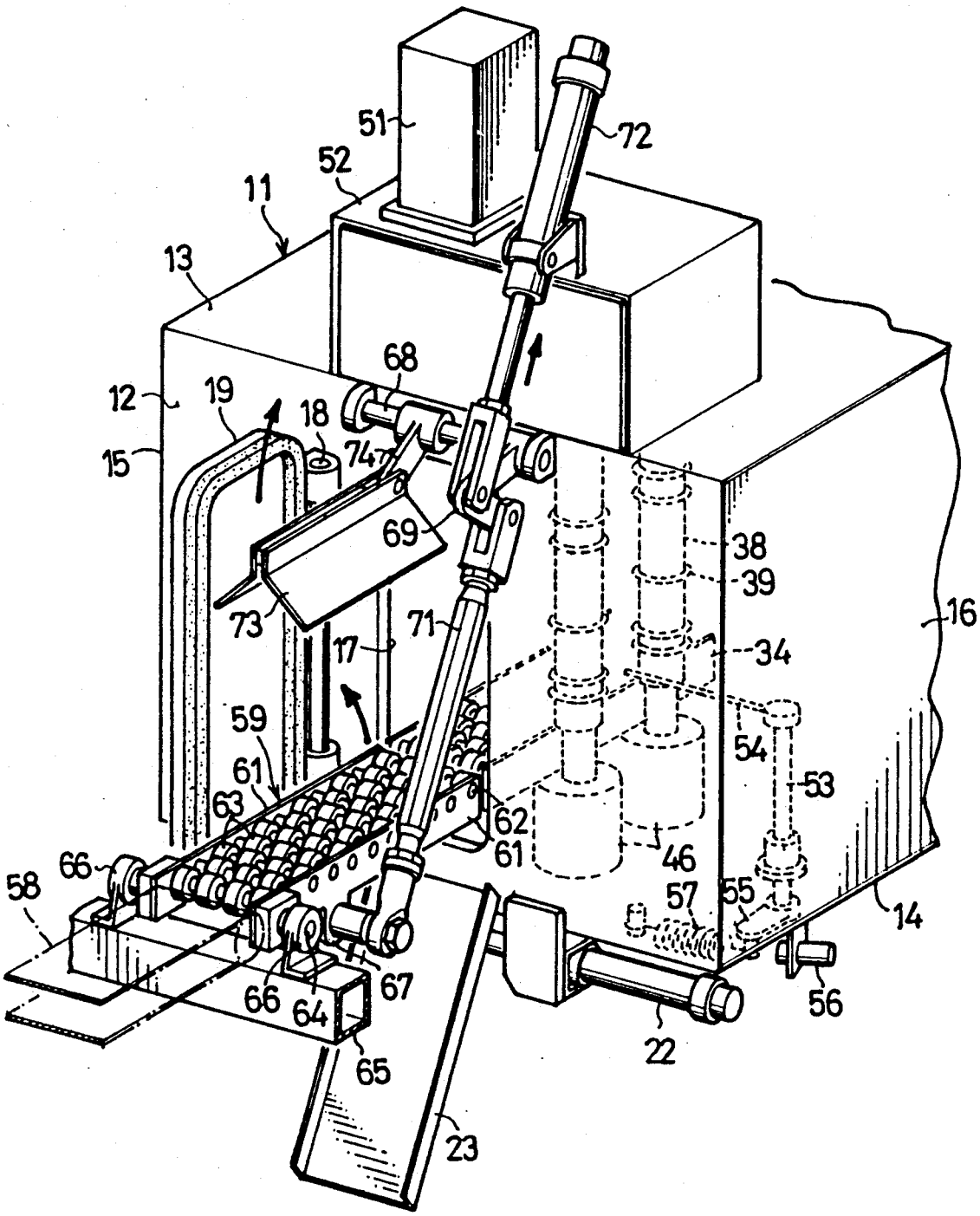
FIG. 2 is a perspective view showing the appearance of the front portion.
Figure 4:
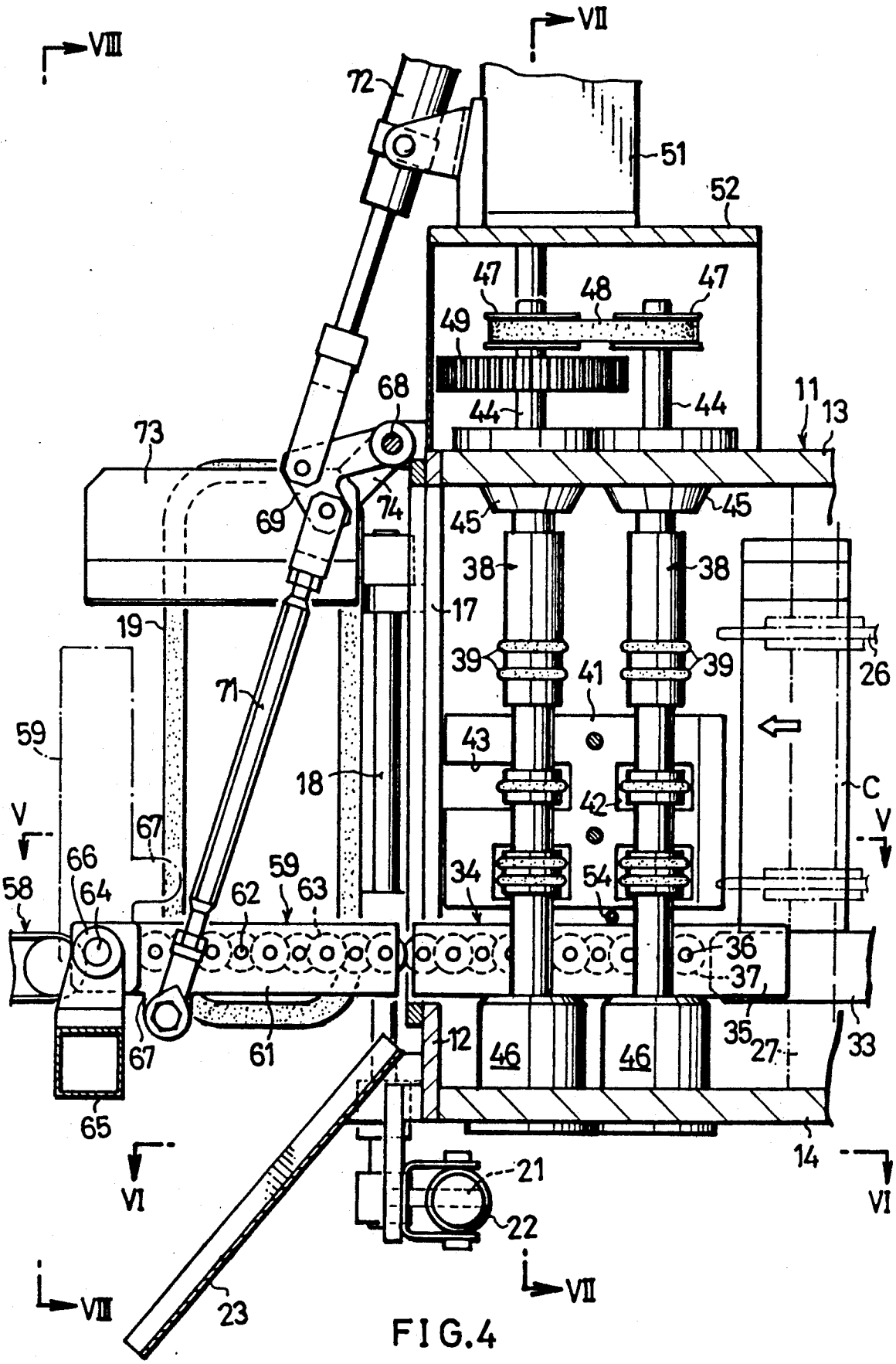

When the piston rod of the hydraulic cylinder 72 is retracted as indicated by an arrow in FIG. 2, the movable transfer member 59 is moved upward along with the container top guide 73 to the raised position as indicated in a phantom line in FIG. 4.

During packaging operation, the closure 19 is open, and the movable transfer member 59 is in its horizontal position. Containers C are transported one after another on the inner conveyor 24, and then sent forward on the fixed transfer member 34 and delivered onto the movable transfer member 59 by the pinch rollers 38. The containers C are thereafter forwarded on the movable transfer member 59 and finally delivered onto the starting end of transport path of the outer conveyor 58 by being pushed by the following container C delivered from the fixed member 34 onto the movable member 59. The containers C are further transported by the conveyor 58 to the subsquent line.

If no container C can be fed to the subsequent line owing to a trouble occurring in the line during the packaging operation, the movable transfer member 59 is moved to the raised position, whereupon containers C are discharged from the fixed transfer member 34 through the chute 23.

When the packaging operation is completed, no container C is sent forward by the inner conveyor 24, and the last container C is delivered from the fixed transfer member 34 onto the movable transfer member 59, whereupon the hydraulic cylinder 72 is operated to move the movable transfer member 59 to the raised position. The containers C remaining on the member 59 then slide down the member 59 onto the starting end of the transport path of the outer conveyor 58 under gravity, and are then transported to the subsequent line by the conveyor 58. Further when the movable transfer member 59 is raised, an unillustrated sensor incorporated in the cylinder 72 detects this. The hydraulic cylinder 22 therefore operates in response to the resulting detection signal to close the closure 19.

To initiate the packaging machine into operation, the closure 19 is opened by operating the horizontal hydraulic cylinder 22, whereupon an unillustrated sensor incorporated in the cylinder 22 detects this, producing a detection signal. In response to this signal, the slanting hydraulic cylinder 72 operates to move the movable transfer member 59 downward to the horizontal position.

What is claimed is:

1. A packaging machine comprising:

a closed aseptic chamber having a required packaging work space as separated from the outside air and a front wall formed with a container outlet, a closure pivotally movably attached to the outer side of the front wall at an edge portion of the container outlet, an inner container conveyor disposed inside the chamber to provide an inner path of transport of containers, the inner transport path having a terminal end positioned to the rear of the container outlet at a distance therefrom, an outer container conveyor disposed outside the chamber to provide an outer path of transport of containers, the outer transport path having a starting end positioned in front of the container outlet at a distance therefrom, a fixed transfer member interposed between the container outlet and the terminal end of the inner transport path and having a rear end connected to the terminal end of the inner transport path, a movable transfer member interposed between the container outlet and the starting end of the outer transport path and movable about its front end upward to a raised position or downward to a horizontal position, the movable transfer member being connected at its front end to the starting end of the outer transport path and at its rear end to the front end of the fixed transfer member when in the horizontal position, the movable transfer member having its front end held connected to the starting end of the outer transport path and its rear end disconnected from the front end of the fixed transfer member when moved to the raised position, means for successively forwarding containers on the fixed transfer member from its rear end to the front end thereof and then delivering the containers from the front end to the rear end of the movable transfer member in the horizontal position, and means for moving the movable transfer member between the horizontal position and the raised position so as to bring the movable transfer member to the raised position, thereby rendering the movable transfer member free of interference with the closure and permitting the containers on the movable transfer member to slide down onto the starting end of the outer transport path under gravity.

2. A packaging machine as defined in claim 1 wherein each of the fixed transfer member and the movable transfer member comprises a pair of opposed side plates extending longitudinally of the machine, a plurality of horizontal support shafts extending between and fixed to the side plates and arranged at a spacing longitudinally of the machine, and a plurality of rollers mounted on each of the support shafts, and the forwarding means comprises at least one pair of vertical pinch rollers arranged on the respective opposite sides of the path of transfer of containers on the fixed transfer member, and drive means for rotating the pair of rollers in directions opposite to each other to forward the containers.

3. A packaging machine as defined in claim 1 or 2 which is adapted to prepare different kinds of containers identical in cross sectional area, made different in height and thereby given different capacities and wherein the inner container conveyor comprises a plurality of holders for holding containers so as to restrain each container from moving horizontally while rendering the container free to move vertically, a liftable rail extending under the path of movement of the container holders in parallel thereto for guiding each container as held by the container holder by supporting the container at its bottom, a tiltable rail connecting the front end of the liftable rail to the rear end of the fixed transfer member, and means for adjusting the liftable rail to different levels in accordance with the different kinds of containers so that the upper ends of different kinds of containers as held by the holders are positioned at a definite level.

4. A packaging machine as defined in claim 2 wherein each of the pinch rollers is externally provided with at least one elastic ring.

5. A packaging machine as defined in claim 4 wherein a pair of opposed guide members each in the form of a vertical plate for guiding the side of the container are fixedly arranged at a small distance inward from the surfaces of the respective pinch rollers, and the guide members are formed at required portions with apertures or cutouts for the inner ends of the elastic rings to project therethrough inwardly of the guide members.

6. A packaging machine a defined in claim 1 which further comprises:

sensor means for detecting the movable transfer member as brought to the raised position to produce a detection signal, and closure opening-closing means operable to close the closure in response to the detection signal.

7. A packaging machine as defined in claim 1 wherein the chamber is provided outside thereof with an emergency discharge slanting chute extending forward obliquely downward approximately from the lower end of the container outlet.

* * * * *